US010450166B2

(12) United States Patent
Dold

(10) Patent No.: US 10,450,166 B2
(45) Date of Patent: Oct. 22, 2019

(54) ELECTRICALLY INSULATING SUSPENSION DEVICE MOUNTING FIXTURE

(71) Applicant: Inventio AG, Hergiswil (CH)

(72) Inventor: Florian Dold, Root (CH)

(73) Assignee: INVENTIO AG, Hergiswil NW (CH)

( * ) Notice: Subject to any disclaimer, the term of this patent is extended or adjusted under 35 U.S.C. 154(b) by 58 days.

(21) Appl. No.: 15/568,835

(22) PCT Filed: Apr. 29, 2016

(86) PCT No.: PCT/EP2016/059578
§ 371 (c)(1),
(2) Date: Oct. 24, 2017

(87) PCT Pub. No.: WO2016/174184
PCT Pub. Date: Nov. 3, 2016

(65) Prior Publication Data

US 2018/0105391 A1 Apr. 19, 2018

(30) Foreign Application Priority Data

Apr. 30, 2015 (EP) ..... 15166033

(51) Int. Cl.
*B66B 7/08* (2006.01)
*B66B 7/06* (2006.01)

(52) U.S. Cl.
CPC ..... *B66B 7/085* (2013.01); *B66B 7/062* (2013.01); *B66B 7/08* (2013.01)

(58) Field of Classification Search
CPC ..... B66B 7/08; B66B 7/085
See application file for complete search history.

(56) References Cited

U.S. PATENT DOCUMENTS

2007/0017749 A1 1/2007 Dold et al.
2007/0034454 A1* 2/2007 Dold ..... B66B 7/062 187/411
2007/0173104 A1* 7/2007 Veronesi ..... B66B 7/062 439/425
2011/0220438 A1* 9/2011 Annen ..... B66B 7/062 187/251
2012/0291230 A1* 11/2012 Hida ..... B66B 7/08 24/136 K
2015/0101889 A1 4/2015 Kere et al.
(Continued)

FOREIGN PATENT DOCUMENTS

CN 101018728 A 8/2007
WO 2014083043 A1 6/2014

*Primary Examiner* — Minh Truong
(74) *Attorney, Agent, or Firm* — William J. Clemens; Shumaker, Loop & Kendrick, LLP

(57) ABSTRACT

An elevator system has a car and a suspension device, wherein the car is least partially carried by the suspension device. The suspension device includes several electrically conductive tension members that are arranged parallel to one another and are essentially enclosed by a jacket. The suspension device is attached to suspension device mounting fixtures, wherein the suspension device mounting fixtures each include a housing and a clamping element. The housing and the clamping element have clamping surfaces between which the suspension device is clamped. The clamping element and/or the housing is made of an electrically insulating material.

6 Claims, 2 Drawing Sheets

(56) References Cited

U.S. PATENT DOCUMENTS

2015/0151948 A1* 6/2015 Pelto-Huikko ..... B66B 9/00
187/254
2016/0152445 A1* 6/2016 Lehtinen ..... B66B 7/085
187/393

* cited by examiner

ELECTRICALLY INSULATING SUSPENSION DEVICE MOUNTING FIXTURE

FIELD

The subject matter of the invention is an elevator system and in particular an embodiment of an attachment of a suspension means in the elevator system.

BACKGROUND

Belt-like suspension means are employed in many elevator systems. In general, such suspension means comprise a plurality of tension members that comprise steel wires and bear the tensile forces to be borne by the support means. In general the tension members are enclosed by a jacket made of plastic.

Such suspension means are a safety-related component within an elevator system. For this reason, test units that in particular test the mechanical condition of the tension members are employed in elevator systems. The purpose for this is to be able, early on, to detect damage to the tension members that bear the forces. Thus, if it is damaged, the support means may be exchanged to prevent the elevator system from failing.

The electrically conductive tension members are enclosed by the electrically insulating jacket made of plastic. For executing a test of the condition of the tension members, normally the tension members are electrically contacted and, using an electrical test current conducted through the tension members, a condition of the tension members is determined. Changes, especially an increase in the electrical resistance of the tension members, indicate deterioration of a condition of the tension members. In order to be able to reliably check the individual tension members, it is important that the tension members are not themselves in electrical contact with one another. Such electrical short circuits between tension members of a suspension means may occur, for instance, at locations at which the suspension means is clamped.

SUMMARY

One object of the present invention is to provide an elevator system in which sheathed tension members of the support means are reliably prevented from electrically short-circuiting one another. The elevator system should also be inexpensive and simple to install.

For attaining this object, an elevator system having a car and a suspension means is suggested. The car is at least partially carried by the suspension means. The suspension means comprises several electrically conductive tension members that are arranged parallel to one another and are essentially enclosed by a jacket. The suspension means has a first side and a second side. The suspension means is attached to suspension means mounting devices, wherein the suspension means mounting devices each comprise a housing and a clamping element. The housing and the clamping element have clamping surfaces between which the suspension means is clamped. The clamping element and/or the housing is made of an electrically insulating material.

Firstly, such an elevator system has the advantage that conventional wedge locks may be used for suspension means mounting devices. The metal clamping element and/or the metal housing of the conventional suspension means mounting device is replaced by an electrically insulating housing and/or an electrically insulating clamping element. This ensures that no electrical bridges occur between the tension members if any contact occurs between the tension members and the suspension means mounting device, and that no grounding of the tension members occurs via the suspension means mounting device. Thus the tension members of the support means remain electrically insulated from one another, even if the jacket is worn through on one side of the suspension means. Such an electrically insulating clamping element and/or housing is inexpensive to manufacture and simple to install in an elevator system. In addition, it is easy to retrofit existing elevator systems with such an electrically insulating clamping element and/or housing.

In one advantageous exemplary embodiment, the first side of the suspension means has a first jacket thickness between the tension members and a first surface of the jacket, and the second side of the suspension means has a second jacket thickness between the tension members and a second surface of the jacket, wherein the first jacket thickness is greater than the second jacket thickness. The second surface is arranged at the clamping element and/or the housing made of an electrically insulating material. Such an arrangement is advantageous because it has been observed that the thinner jacket thickness wears through on the second side of the suspension means faster than the greater jacket thickness on the first side of the suspension means. Thus in this exemplary embodiment it may be enough to electrically insulate only the side of the suspension means having the thinner jacket thickness from the suspension means mounting device.

In one advantageous exemplary embodiment, the first side of the suspension means is a traction side that is in contact with a traction sheave of a drive. The second side of the suspension means is a back side, wherein this second side is arranged at the clamping element. The clamping element is made of an electrically insulating material. Such an arrangement is advantageous because it has been observed that the generally thinner jacket thickness wears through more rapidly on the back side of the suspension means than the generally thicker jacket on the traction side of the suspension means. Thus in this exemplary embodiment it may be enough to electrically insulate only the side of the suspension means from the suspension means mounting device.

In another advantageous embodiment, both the housing and the clamping element are made of an electrically insulating material. Such an arrangement is advantageous when it may be expected that either the jacket on the back side of the suspension means or the jacket on the traction side of the suspension means could be damaged during use.

In one advantageous embodiment, a profile, for instance in the shape of longitudinal ribs, is embodied on the traction side of the suspension means. Such longitudinal ribs have the advantage that traction between the suspension means and a traction sheave is increased and that in addition the jacket on the traction side is prevented from wearing down to the tension members.

The electrically insulating material may be made from different materials. For instance, it may be made of a non-metal material, which has the advantage that no short circuit can occur between two tension members via the clamping element or the housing.

In one alternative embodiment, the electrical insulating material is made of ceramic, which has the advantage that in this way a thermally and chemically stable element may be formed.

In one alternative embodiment, the electrical insulating material is made of a plastic, which has the advantage that in this way an advantageous pressure distribution on the tension members may be attained.

In one alternative embodiment, the electrical insulating material is made of wood or impregnated wood, which has the advantage that in this way a renewable, biodegradable raw material may be used.

What is essential in these various embodiments of the electrically insulating material is that the tension members are effectively electrically insulated from one another if there is a defective jacket of the suspension means in the suspension means mounting device.

In one advantageous exemplary embodiment, the clamping element is embodied as a wedge. In one alternative exemplary embodiment, the clamping element is embodied differently, for instance having a circular, oval, polygonal, or irregularly shaped cross-section. The clamping element does not necessarily have to be embodied as a body having a constant cross-section; other bodies may also be used for clamping elements.

In one advantageous exemplary embodiment, the clamping element and/or the housing are embodied in one piece. This has the advantage that a continuously electrically insulating effect of these components may be assured in this way.

DESCRIPTION OF THE DRAWINGS

Details and advantages of the invention shall be described in the following using exemplary embodiments and referencing the schematic drawings.

Shown are.

DETAILED DESCRIPTION

Figure 1:
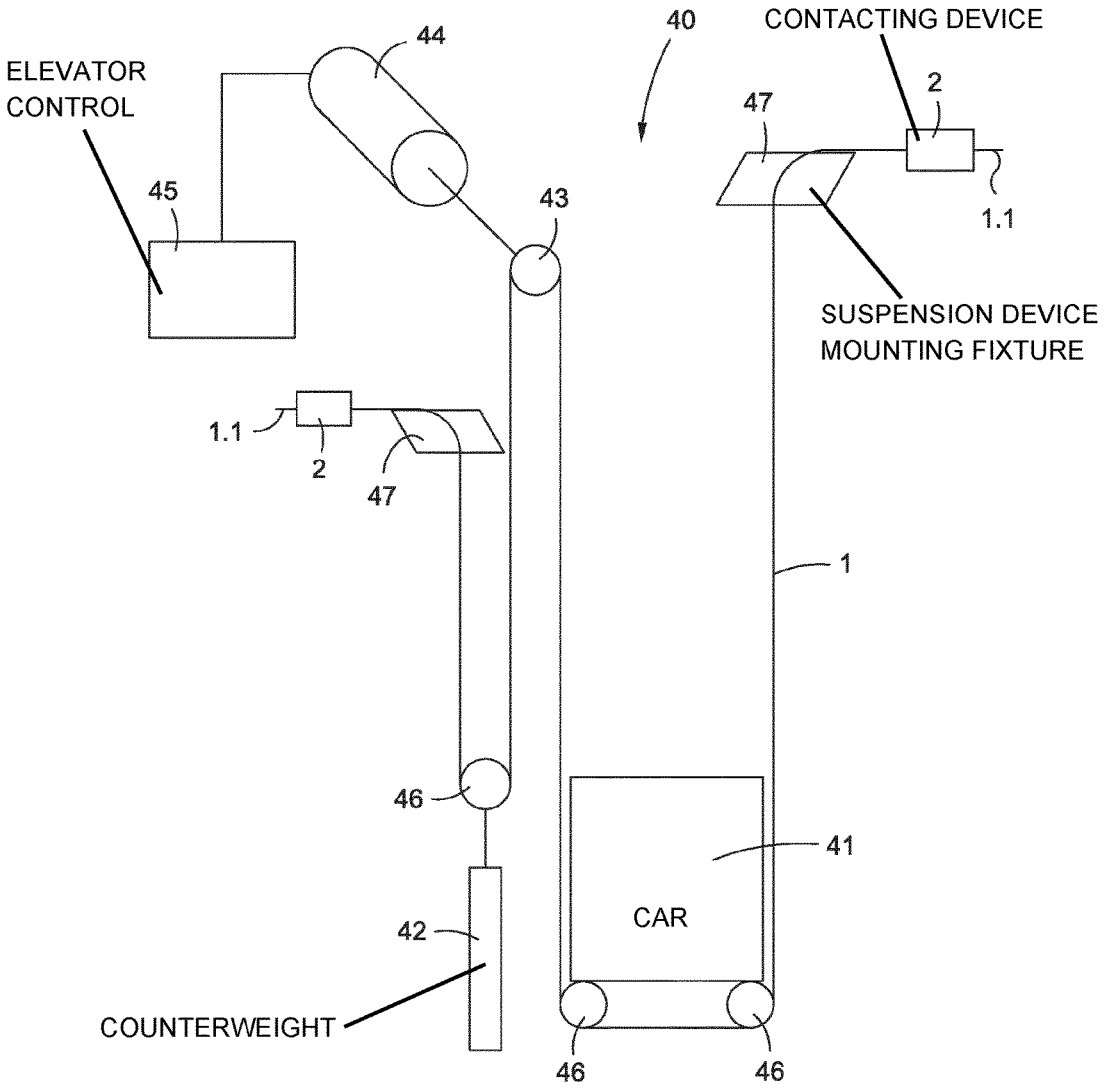
FIG. 1 is one exemplary embodiment of an elevator system.

The elevator system 40 depicted schematically and by way of example in FIG. 1 includes an elevator car 41, a counterweight 42 and a suspension means or suspension device 1, as well as a traction sheave 43 along with associated drive motor 44. Traction sheave 43 drives suspension means 1 and thereby moves elevator car 41 and, in mirror-inverted motion, counterweight 42. Drive motor 44 is controlled by an elevator control 45. Car 41 is designed to hold people and/or freight and transport them between floors of a building. Car 41 and counterweight 42 are guided along by guides (not depicted). In the example, car 41 and counterweight 42 are each suspended on support rollers 46. In this arrangement, suspension means 1 is secured to a first suspension means mounting fixture 47 and then first guided around support roller 46 of counterweight 42. Then, suspension means 1 is placed over traction sheave 43, guided around support roller 46 of car 41 and finally connected to a fixed point by a second suspension means mounting fixture 47. This means that suspension means 1 runs through drive 43, 44 at a higher speed than car 41 or counterweight 42 corresponding to a reeving factor. In the example the reeving factor is 2 to 1.

A loose end 1.1 of suspension means 1 is provided with contacting device 2 for the temporary or permanent contacting and monitoring of the suspension means 1. In the depicted example, such a contacting device 2 is arranged at both ends of suspension means 1. In an alternative embodiment, not depicted, only one contacting device 2 is arranged at suspension means ends 1.1. Suspension means ends 1.1 are no longer loaded by the tensile force in suspension means 1 because this tensile force is already conducted beforehand through the suspension means mounting fixtures 47 into the building.

The contacting devices 2 are therefore arranged in an area of suspension means 1 that is not rolled over and are outside the loaded area of suspension means 1.

Elevator system 40 shown in FIG. 1 is an example. Other reeving factors and arrangements, such as elevator systems without a counterweight, are possible. Contacting device 2 for contacting suspensions means 1 is then arranged corresponding to the placement of suspension means mounting fixtures 47.

Figure 2:
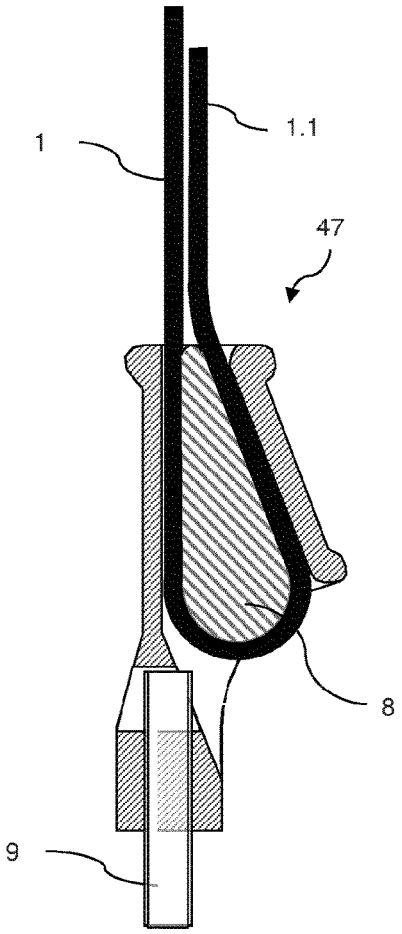
FIG. 2 is one exemplary embodiment of a suspension means mounting device.

An exemplary embodiment of a suspension means mounting device 47 is depicted in FIG. 2 with suspension means 1 placed therein. Suspension means mounting device 47 comprises a housing and clamping element 8 arranged therein. The housing is attached to an element in the elevator system via threaded bar 9. Suspension means mounting device 47 may be connected to a car, counterweight or carrier via threaded bar 9.

Suspension means 1 placed in suspension means mounting device 47 has a loaded side and loose suspension means end 1.1. Suspension means 1 is clamped in suspension means mounting device 47 by clamping surfaces of clamping element 8 and the housing.

To electrically insulate at least one side of suspension means 1 from the clamping surfaces of clamping element 8 and the housing, clamping element 8 and/or the housing are made of an electrically insulating material, for instance ceramic.

Figure 3A:
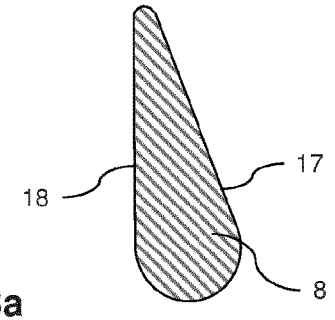
FIG. 3*a* is one exemplary embodiment of a housing of a suspension means mounting device.
Figure 3B:
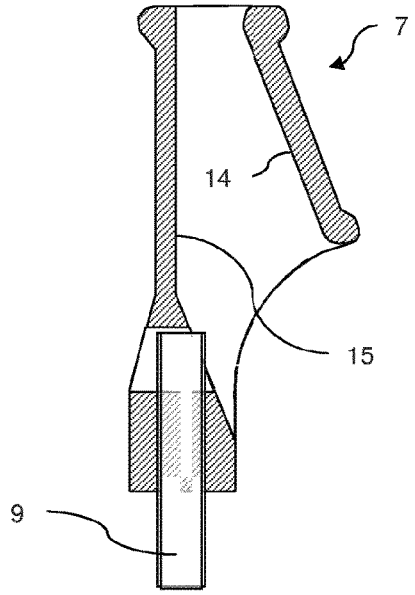
FIG. 3*b* is one exemplary embodiment of a clamping element of a suspension means mounting device; and, FIG. 4 is one exemplary embodiment of a suspension means.

Clamping element 8 and housing 7 are depicted in FIGS. 3*a* and 3*b*. When in use, the suspension means is clamped between clamping surfaces 17, 18 of clamping element 8 and clamping surfaces 14, 15 of housing 7. To electrically insulate at least one side of the suspension means from clamping surfaces 17, 18 of clamping element 8 and clamping surfaces 14, 15 of housing 7, clamping element 8 and/or housing 7 are made of an electrically insulating material, for instance ceramic.

Housing 7 and clamping element 8 are embodied in one piece in FIGS. 3*a* and 3*b*.

Figure 4:
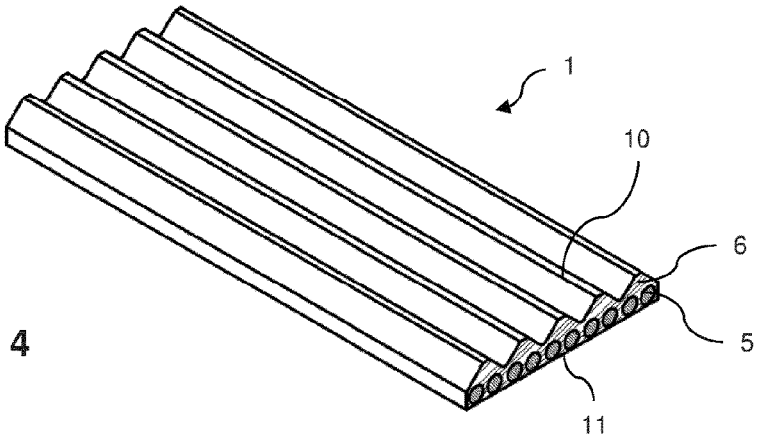

Depicted in FIG. 4 is an exemplary embodiment of a suspension means 1. Suspension means 1 comprises several electrically conductive tension members 5 that are arranged parallel to one another and are essentially enclosed by jacket 6. Suspension means 1 has first side 10 and second side 11. First side 10 of suspension means 1 is embodied as a traction side that is in contact with a traction sheave of a drive. Second side 11 of suspension means 1 is embodied as a back side. In this exemplary embodiment, traction side 10 comprises longitudinal ribs. Such ribs enhance traction of suspension means 1 on the traction sheave and also improve protection of tension members 5.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system having a car and a suspension device, wherein the car is at least partially carried by the suspension device, wherein the suspension device includes several electrically conductive tension members that are arranged parallel to one another and are essentially enclosed by jacket, wherein the suspension device has a first side and a second side, wherein the suspension device is attached to suspension device mounting fixtures, the suspension device mounting fixtures each comprising:

a housing;

a clamping element, wherein the housing and the clamping element each have clamping surfaces between which the suspension device is clamped;

wherein the clamping element is formed of an electrically insulating material being a ceramic material or wood;

wherein the housing is formed of an electrically insulating material being a ceramic material or wood; and wherein the clamping element is formed as a wedge and the suspension device is configured to wrap around the wedge.

2. The elevator system according to claim 1 wherein the first side of the suspension device has a first jacket thickness between the tension members and a first surface of the jacket, wherein the second side of the suspension device has a second jacket thickness between the tension members and a second surface of the jacket, wherein the first jacket thickness is greater than the second jacket thickness, and wherein the second surface is arranged on the clamping element formed of the electrically insulating material or the housing formed of the electrically insulating material.

3. The elevator system according to claim 2 wherein the first side of the suspension device is a traction side that is in contact with a traction sheave of a drive, wherein the second side of the suspension device is a back side, wherein the second side of the suspension device is arranged on the clamping element.

4. The elevator system according to claim 3 wherein longitudinal ribs are embodied on the traction side of the suspension device.

5. The elevator system according to claim 1 wherein the wood is an impregnated wood.

6. The elevator system according to claim 1 wherein at least one of the clamping element and the housing is a single piece.

* * * * *